US011415336B2

(12) United States Patent
Liu et al.

(10) Patent No.: US 11,415,336 B2
(45) Date of Patent: Aug. 16, 2022

(54) METHOD AND APPARATUS FOR CONTROLLING HEATING OPERATION OF AIR CONDITIONER

(71) Applicant: QINGDAO HAIER AIR CONDITIONER GENERAL CORP., LTD., Qingdao (CN)

(72) Inventors: Juke Liu, Qingdao (CN); Beibei Xu, Qingdao (CN); Guojing Xu, Qingdao (CN); Xingyu Lv, Qingdao (CN)

(73) Assignee: QINGDAO HAIER AIR CONDITIONER GENERAL CORP., LTD., Qingdao (CN)

( * ) Notice: Subject to any disclaimer, the term of this patent is extended or adjusted under 35 U.S.C. 154(b) by 242 days.

(21) Appl. No.: 16/608,286

(22) PCT Filed: Apr. 6, 2018

(86) PCT No.: PCT/CN2018/082080
§ 371 (c)(1),
(2) Date: Feb. 11, 2021

(87) PCT Pub. No.: WO2018/196580
PCT Pub. Date: Nov. 1, 2018

(65) Prior Publication Data

US 2021/0164685 A1 Jun. 3, 2021

(30) Foreign Application Priority Data

Apr. 25, 2017 (CN) ..... 201710277883.4

(51) Int. Cl.
*F24F 11/86* (2018.01)
*F24F 11/63* (2018.01)
*F24F 110/10* (2018.01)

(52) U.S. Cl.
CPC ..... *F24F 11/86* (2018.01); *F24F 11/63* (2018.01); *F24F 2110/10* (2018.01); *F24F 2221/34* (2013.01)

(58) Field of Classification Search
CPC ..... F24F 11/86; F24F 11/63; F24F 2110/10; F24F 2221/34
(Continued)

(56) References Cited

FOREIGN PATENT DOCUMENTS

CN 101526260 A 9/2009
CN 101813360 A * 8/2010
(Continued)

*Primary Examiner* — Jigneshkumar C Patel
(74) *Attorney, Agent, or Firm* — Jiwen Chen; Jacobson Holman PLLC

(57) ABSTRACT

A method for controlling the heating operation of an air conditioner. The method comprises: an air conditioner executing a heating operation, and acquiring an indoor temperature; if the indoor temperature is not greater than the first indoor temperature threshold value, executing fuzzy control; according to the difference in temperature between the indoor temperature and a set target indoor temperature, carrying out room temperature PID calculation so as to acquire a first target frequency; acquiring a coil temperature of an indoor heat exchanger, and if the coil temperature is greater than a set target coil temperature, determining the first target frequency to be an indoor unit frequency; otherwise, increasing the current operation frequency of a compressor so as to obtain a second target frequency, selecting the larger value of the first target frequency and the second target frequency, and determining the larger value to be the indoor unit frequency; controlling the compressor of the air conditioner according to the indoor unit frequency; and while executing dual PID control, according to the coil temperature, controlling electrical heating. Further disclosed is an apparatus for controlling the heating operation of an air conditioner. By means of the method and apparatus, the
(Continued)

problem of heating being uncomfortable due to the fact that existing air conditioners are slow to provide heating can be solved.

9 Claims, 2 Drawing Sheets

(58) Field of Classification Search
USPC ..... 700/276
See application file for complete search history.

(56) References Cited

FOREIGN PATENT DOCUMENTS

| | | | | | |
|---|---|---|---|---|---|
| CN | 101813360 | A | | 8/2010 | |
| CN | 103542494 | A | | 1/2014 | |
| CN | 104697109 | A | | 6/2015 | |
| CN | 104713196 | A | * | 6/2015 | ..... F24F 11/006 |
| CN | 104713196 | A | | 6/2015 | |
| CN | 104764150 | A | | 7/2015 | |
| CN | 104764151 | A | | 7/2015 | |
| CN | 105042796 | A | | 11/2015 | |
| CN | 105042799 | A | | 11/2015 | |
| CN | 105091243 | A | | 11/2015 | |
| CN | 105202694 | A | | 12/2015 | |
| JP | H05322278 | A | | 12/1993 | |
| JP | H0735191 | | | 2/1995 | |

* cited by examiner

METHOD AND APPARATUS FOR CONTROLLING HEATING OPERATION OF AIR CONDITIONER

This is a U.S. national stage application of PCT Application No. PCT/CN2018/082080 under 35 U.S.C. 371, filed Apr. 6, 2018 in Chinese, claiming priority of Chinese Application No. 201710277883.4, filed Apr. 25, 2017, all of which are hereby incorporated by reference.

TECHNOLOGY FIELD

The present invention relates to the technical field of air conditioning, and particularly to the control of air conditioner, and more particularly to a method and an apparatus for controlling heating operation of air conditioner.

BACKGROUND TECHNOLOGY

In the cold winter, an air conditioner plays a vital role to warm up facilities, especially in areas where no heating systems are installed or during those days when the heating supply period of the national central heating system ends but the weather is still cold.

In general, a typical compressor frequency control of air conditioner in heating operation is based on an algorithm to correct a temperature error between a set-up room temperature and a detected room temperature, with which if the calculated target frequency is not high enough, the room temperature will rise very slowly, which causes a problem that the room temperature could not reach to the target value even the A/C system has been working for a while and the indoor environment could not turn into comfort rapidly; if the room temperature is extreme low, it has to spend longer time waiting for it to rise to the desired temperature.

Therefore, how to reduce the discomfort caused by slow room temperature rise is a critical factor to improve the performance of an air conditioner.

SUMMARY OF THE INVENTION

An object of the present invention is to provide a method for controlling heating operation of air conditioner, so as to reduce the discomfort caused by slow room temperature rise.

In order to achieve the above object, the method for controlling heating operation of air conditioner provided by the present invention is implemented by the following technical solutions:

An air conditioner heating operation control method comprises:

Obtaining an indoor temperature as the air conditioner working in heating mode and comparing the indoor temperature with a first indoor temperature threshold;

Performing a fuzzy control process if the indoor temperature is not greater than the first indoor temperature threshold;

Calculating a difference between the indoor temperature and a set target indoor temperature to obtain an indoor temperature difference; performing a PID calculation according to the indoor temperature difference to obtain a first target frequency; obtaining the coil temperature of the heat exchanger within the indoor unit and comparing the coil temperature with a set target coil temperature; if the coil temperature is greater than the set target coil temperature, performing a frequency control on the compressor in which the first target frequency is used as the objective frequency point of the compressor; if the coil temperature is not greater than the set coil temperature, then increasing the current running frequency of the compressor to a second target frequency and performing a frequency control on the compressor in which the greater one between the first target frequency and the second target frequency is used as the objective frequency point of the compressor.

As performing the fuzzy control, determining whether the coil temperature satisfies electric heating device on/off conditions; if the coil temperature satisfies the electric heating device on condition, turning on the electric heating device of the air conditioner; if the coil temperature satisfies the electric heating device off condition, turning off the electric heating device of the air conditioner; wherein the electric heating device on/off conditions are determined by the coil temperature and the set target coil temperature.

In order to achieve the aforesaid object, the heating control apparatus provided by the present invention is implemented by the following technical solutions:

An air conditioner heating operation control apparatus, characterized in that the apparatus comprises:

An indoor temperature obtaining unit, which is configured to obtain an indoor temperature;

A temperature comparison unit, which is configured to compare the indoor temperature obtained by the indoor temperature obtaining unit with an indoor temperature threshold and output a comparison result;

A fuzzy logic control unit, which is configured to calculate a difference between the indoor temperature obtained by the indoor temperature obtaining unit and a set indoor temperature threshold to obtain an indoor temperature difference as the temperature comparison unit outputs a result that the indoor temperature is not greater than the first indoor temperature threshold, and to perform a PID calculation according to the indoor temperature difference to obtain a first target frequency; and to obtain a coil temperature of the heat exchanger within the indoor unit and compare the coil temperature with the set target coil temperature; and to perform a frequency control on the compressor in which the first target frequency is used as the objective frequency point of the compressor if the coil temperature is greater than the set target coil temperature or to increase the current running frequency of the compressor to a second target frequency and perform a frequency control on the compressor in which the greater one between the first target frequency and the second target frequency is used as the objective frequency point of the compressor;

An electric heating control unit, which is used to determine whether or not he coil temperature obtained by the fuzzy logic control unit satisfies electric heating device on/off conditions as the fuzzy logic control unit performing the fuzzy control process; to turn on/off the electric heating device as satisfying the electric heating device on/off conditions, wherein the electric heating device on/off conditions are determined according to the coil temperature and the set target coil temperature.

Compared with the prior art, the advantages and positive effects of the present invention are: as controlling heating operation of air conditioner with the process as described above, if the indoor temperature is not greater than the first indoor temperature threshold, then performing a fuzzy control in which the greater one between a frequency obtained in the PID calculation according to the indoor temperature difference and a frequency obtained by the coil temperature of the indoor heat exchanger is used as the objective frequency point of the compressor so as to ensure that the compressor could run at a high speed as the indoor temperature and the coil temperature are both low and the room temperature could increase to a desired temperature rapidly, and the outlet air temperature of air conditioner is mild so as to effectively solve the problem that the room temperature could not reach to the target value even the A/C system has been working for a while and the indoor environment could not turn into warm rapidly. Moreover, the step that to control the electric heating device within air conditioner based on the coil temperature as performing the fuzzy control could improve heating performance, enabling it to be more accurate and energy-saving.

Advantages and features of the present disclosure and methods for accomplishing the same will be more clearly understood from exemplary embodiments described below with reference to the accompanying drawings.

DETAILED DESCRIPTION OF THE INVENTION

The present invention will be further described in detail below with reference to the accompanying drawings and embodiments.

Figure 1:
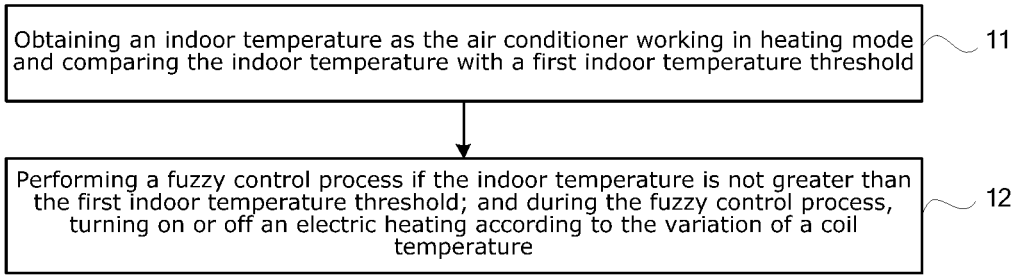
FIG. 1 is a flow chart showing a method for controlling heating operation of air conditioner in accordance with one embodiment of the present invention.

FIG. 1 is a flow chart showing a method for controlling heating operation of air conditioner in accordance with one embodiment of the present invention.

As shown in FIG. 1, the specific process of the method for controlling heating operation of air conditioner comprises:

Step 11: Obtaining an indoor temperature as the air conditioner working in heating mode and comparing the indoor temperature with a first indoor temperature threshold.

Specifically, the indoor temperature refers to a real-time indoor temperature of a room where the indoor unit of air conditioner is arranged measured at a sampling rate as the air conditioner running at heating mode; the indoor temperature could be obtained by those means already available to the public, such as using a temperature sensor disposed at or around the air inlet of the air conditioner to detect an inlet air temperature and using the inlet air temperature as the indoor temperature.

Then the indoor temperature is being compared with the first indoor temperature threshold, wherein the first indoor temperature threshold is used to determine whether or not to start executing a fuzzy control process, which could be a default written in control program and proprietary for manufacturer or a set temperature point input from the user. If users hope to set the first indoor temperature threshold by themselves, the program would provide a recommended reference temperature value. Preferably, the preset first indoor temperature threshold or the recommended first indoor temperature threshold could be 20° C.

Step 12: Performing a fuzzy control process if the indoor temperature is not greater than the first indoor temperature threshold; and during the fuzzy control process, turning on or off an electric heating according to the variation of a coil temperature.

Wherein the fuzzy control specifically includes:

Calculating a difference between the indoor temperature and a set target indoor temperature to obtain an indoor temperature difference; performing a PID calculation according to the indoor temperature difference to obtain a first target frequency; wherein the indoor temperature specifically refers to the indoor temperature obtained in Step 11 and the set target indoor temperature is a desired temperature of the room environment set by the user; the specific indoor temperature PID algorithm to obtain the first target frequency could refer to those PID algorithms used in the prior art, with which the PID output controls the compressor speed through a variable frequency drive according to the room temperature demand.

In the meanwhile, obtaining the coil temperature of the heat exchanger within the indoor unit and comparing the coil temperature with a set target coil temperature; if the coil temperature is greater than the set target coil temperature, performing a frequency control on the compressor in which the first target frequency, which is obtained in the PID calculation according to the indoor temperature difference, is used as the objective frequency point of the compressor; if the coil temperature is not greater than the set coil temperature, then increasing the current running frequency of the compressor to a second target frequency and performing a frequency control on the compressor in which the greater one between the first target frequency and the second target frequency is used as the objective frequency point of the compressor.

The coil temperature is a real-time temperature of the heat exchanger coil in the indoor unit, which is measured by a temperature sensor disposed on the heat exchanger and sampled at a set sampling rate. The set target coil temperature is a desired value of the heat exchanger coil in the indoor unit, which could be a default temperature value written in the control program as manufacturing, also could be a temperature value set by the user; if it is set by the user, the air conditioner will provide a recommended temperature for reference. Preferably, the preset set target coil temperature or the recommended set target coil temperature is in a range from 42-56° C. and an optimal value is 50° C.

If the coil temperature is greater than the set target coil temperature, the coil temperature is relatively high and it indicates that the outlet air temperature of the air conditioner determined by the coil temperature is not going to be very low. Hence under this condition, the room temperature could be taken as the main control target so as to perform the frequency control on the compressor in which the first target frequency is used as the objective frequency point of the compressor, and the specific frequency control process could refer to those skills available to the public.

If the coil temperature is not greater than the set target coil temperature, the coil temperature is relatively low and it indicates that the outlet air temperature of the air conditioner determined by the coil temperature is going to be very low which may make the user discomfort. Under this condition, the coil temperature should be raised, but the room temperature also could be taken as an important control target, so the current running frequency of the compressor is increased to the second target frequency to perform the frequency control on the compressor in which the greater one between the first target frequency and the second target frequency is used as the objective frequency point of the compressor, the specific frequency control process could refer to those skills available to the public. The increase of the current running frequency of the compressor to the second target frequency aims at enabling the current coil temperature to approach to the set coil temperature.

As performing the fuzzy control, it is preferable to control an electric heating device within the air conditioner based on the coil temperature at the same time. The process specifically includes: determining whether the coil temperature satisfies electric heating device on/off conditions; if the coil temperature satisfies the electric heating device on condition, turning on the electric heating device of the air conditioner; if the coil temperature satisfies the electric heating device off condition, turning off the electric heating device of the air conditioner; wherein the electric heating device on/off conditions are determined by the coil temperature and the set target coil temperature, as an example, the electric heating device on condition includes: the coil temperature is less than the set target coil temperature and the difference between the set target coil temperature and the coil temperature is greater than a set difference (such that the set difference could be set as 2° C.); the electric heating device off condition is either that the coil temperature is less than the set target coil temperature but the difference between the set target coil temperature and the coil temperature is not greater than the set difference; or that the coil temperature is not less than the set target coil temperature.

This step that to control the electric heating device within air conditioner based on the coil temperature as performing the fuzzy control could on one hand increase the outlet air temperature, especially as the coil temperature is comparatively low, the working electric heating device could increase the coil temperature; and on the other hand, as the coil temperature is comparatively high, the electric heating device could be turned off automatically to save energy, and the outlet air temperature is directly determined by the coil temperature. Therefore, comparing with the control process to control the electric heating device based on the room temperature in the prior art, it is more accurate and energy-saving to control it on the basis of the coil temperature.

As controlling heating operation of air conditioner with the process as described above, if the indoor temperature is not greater than the first indoor temperature threshold, it indicates that the current indoor temperature is comparatively low and then performing a fuzzy control in which the greater one between a frequency obtained in the PID calculation according to the indoor temperature difference and a frequency obtained by the coil temperature of the indoor heat exchanger is used as the objective frequency point of the compressor so as to ensure that the compressor could run at a high speed as the indoor temperature and the coil temperature are both low and the room temperature could increase to a desired temperature rapidly, and the outlet air temperature of air conditioner is mild so as to effectively solve the problem that the room temperature could not reach to the target value even the A/C system has been working for a while and the indoor environment could not turn into warm rapidly. Moreover, the fuzzy control further could ensure the compressor runs at a high speed by increasing the current frequency to a higher value after the coil temperature determination even the user mistakenly sets a comparatively low indoor target temperature, so as to increase the indoor temperature to a desired point to make people feel comfortable, and hence to improve the overall performance of air conditioner in heating operation.

Figure 2:
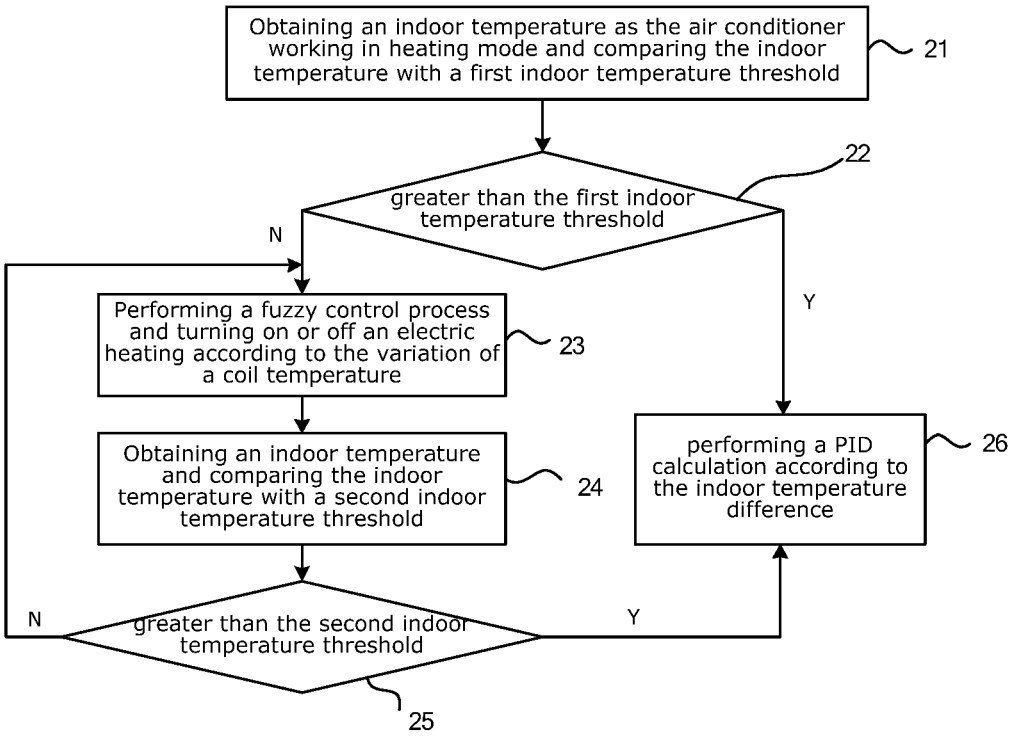
FIG. 2 is a flow chart showing a method for controlling heating operation of air conditioner in accordance with another embodiment of the present invention.

FIG. 2 is a flow chart showing a method for controlling heating operation of air conditioner in accordance with another embodiment of the present invention.

As shown in FIG. 2, the specific process of the method for controlling heating operation of air conditioner comprises:

Step 21: Obtaining an indoor temperature as the air conditioner working in heating mode and comparing the indoor temperature with a first indoor temperature threshold.

Specifically, the indoor temperature refers to a real-time indoor temperature of a room where the indoor unit of air conditioner is arranged measured at a sampling rate as the air conditioner running at heating mode; the indoor temperature could be obtained by those means already available to the public, such as using a temperature sensor disposed at or around the air inlet of the air conditioner to detect an inlet air temperature and using the inlet air temperature as the indoor temperature.

Then the indoor temperature is being compared with the first indoor temperature threshold, wherein the first indoor temperature could be a default written in control program and proprietary for manufacturer or a set temperature point input from the user. If users hope to set the first indoor temperature threshold by themselves, the program could provide a recommended value for reference. Preferably, the preset first indoor temperature threshold or the recommended first indoor temperature threshold could be set as 20° C.

Step 22: Performing Step 26 if the indoor temperature is greater than the first indoor temperature threshold; otherwise, perform Step 23.

Step 23: Performing a fuzzy control process and control an electric heating device within the air conditioner based on a coil temperature.

If in the step 22 it is determined that the indoor temperature is not greater than the first indoor temperature threshold, then performing the fuzzy control process and controlling the electric heating device within the air conditioner based on the coil temperature at the same time. The specific procedures of the fuzzy control process, as well as how to control the electric heating device based on the coil temperature could refer to the description of the embodiment shown in FIG. 1.

Step 24: Obtaining an indoor temperature and comparing the indoor temperature with a second indoor temperature threshold.

To be specific, during the fuzzy control process, it is necessary to obtain an indoor temperature to compare with a second indoor temperature threshold, wherein the second indoor temperature is used to determine whether or not to exit the fuzzy control process, which also could be a default written in control program and proprietary for manufacturer or a set temperature point input from the user. If the user hopes to set the second indoor temperature threshold, the program could provide a recommended value for reference. Preferably, the preset second indoor temperature threshold or the recommended second indoor temperature threshold could be set as 25° C.

Step 25: Performing Step 26 if the indoor temperature is greater than the second indoor temperature threshold; otherwise, perform Step 23.

If the indoor temperature is not greater than the second indoor temperature threshold, then go to Step 23 and continue to perform the fuzzy control process. If the indoor temperature is greater than the second indoor temperature threshold, then exit the fuzzy control process and perform Step 26. The purpose of these actions is to enable the compressor to be operated at a comparatively slow speed as the room temperature reaches to the second indoor temperature threshold which indicates a comfortable room temperature instead of a high frequency so as to avoid the situation that the compressor automatically stops as the room temperature reaches to the target room temperature.

Step 26: Performing a PID control according to the indoor temperature difference.

Whether or not to perform Step 26 is determined according to the results output by Step 22 or Step 25. To be specific, if it is determined in Step 22 that the indoor temperature is greater than the first indoor temperature threshold before performing the fuzzy control process, then performing the indoor temperature PID control instead of the fuzzy control. That is to say if the indoor temperature is greater than the first indoor temperature threshold, it means that the indoor temperature is not very low, so the typical indoor temperature PID control is being performed not taking the coil temperature into consideration: calculating a difference between the indoor temperature and a set target indoor temperature to obtain an indoor temperature difference; performing a PID calculation according to the indoor temperature difference to obtain a first target frequency; performing a frequency control on the compressor in which the first target frequency is used as the objective frequency point of the compressor. If it is determined in Step 25 that the indoor temperature is greater than the second indoor temperature in the mid of performing the fuzzy control process, then exiting the fuzzy control process and then performing the indoor temperature PID control. That is to say, if the indoor temperature is greater than the second indoor temperature threshold in the mid of performing the fuzzy control process, in order to avoid the situation that the compressor automatically stops as the room temperature reaches to the target room temperature, the coil temperature is not be taken into consideration anymore and the traditional indoor temperature PID control is being performed: calculating a difference between the indoor temperature and a set target indoor temperature to obtain an indoor temperature difference; performing a PID calculation according to the indoor temperature difference to obtain a first target frequency; performing a frequency control on the compressor in which the first target frequency is used as the objective frequency point of the compressor.

Other technical effects achieved by the method shown in FIG. 2 could refer to the description of the embodiment shown in FIG. 1.

In the fuzzy control process shown in above embodiments, various methods could be used to determine a second target frequency. In some of the preferable embodiments, the following method could be used to determine the second target frequency.

After obtaining the coil temperature, it is firstly determined whether or not it is the first time that the coil temperature not greater than the set target coil temperature since the air conditioner starts working and then executing different procedures according to different results. To be specific, if it is the first time that the coil temperature is not greater than the set target coil temperature since the air conditioner starts working, in order to increase the coil temperature as soon as possible, the set heating operation maximum frequency of air conditioner is chosen as the second target frequency, wherein the set heating operation maximum frequency is the set maximum frequency for the heating operation of air conditioner. If it is not the first time that the coil temperature is not greater than the set target coil temperature since the air conditioner starts working, the current running frequency of the compressor is being increased to obtain a second target frequency between the current running frequency and the set heating operation maximum frequency. If it is not the first time that the coil temperature is not greater than the set target coil temperature since the air conditioner starts working, it indicates that the fuzzy control process has been executed before and the coil temperature is not much lower than the target coil temperature, and therefore it is not necessary to choose the set heating operation maximum frequency as the second target frequency and a frequency between the current running frequency and the set heating operation maximum frequency would be more appropriate, which further could avoid the situation that the compressor automatically stops as the room temperature reaches to the target room temperature.

Moreover, if it is not the first time that the coil temperature is not greater than the set target coil temperature since the air conditioner starts working, then obtaining the current running frequency and adding a set adjustment frequency on the current running frequency every set adjustment period and setting the increased frequency as the second target frequency. Further, after each time for adding the set adjustment frequency on the current running frequency, it is firstly to determine whether or not the difference between the set target coil temperature and the coil temperature is not less than a preset overshoot value.

If the difference is not less than the preset overshoot value, then as the set adjustment period ends adding the set adjustment frequency on the current running frequency and set the increased frequency as the second target frequency; otherwise the second target frequency is kept unchanged.

Specifically, if it is not the first time that the coil temperature is not greater than the set target coil temperature since the air conditioner starts working, the second target frequency could be set by the following procedures: obtaining the current running frequency, adding a set adjustment frequency on the current running frequency and setting the increased frequency as the second target frequency. The set adjustment frequency could be a default written in control program and proprietary for manufacturer or a set frequency value input from the user, such as set as 5 Hz. The set adjustment frequency could be regarded as a frequency adjustment step length which represents the increment on the basis of current running frequency each time. The frequency is being increased every set adjustment period and it is a stepwise control process. The increased frequency is used as the set target frequency. After the current frequency being increased the set adjustment frequency, it is firstly to determine whether or not the difference between the set target coil temperature and the coil temperature is greater than the overshoot temperature value. The overshoot temperature value is a set temperature value, such as 1° C. If it is determined that the difference between the set target coil temperature and the coil temperature is greater than the overshoot temperature value, the result means that the coil temperature is much lower than the set target coil temperature and the frequency should be increased further. As mentioned above, the increase of the frequency should follow a step by step manner in which the frequency is increased every set adjustment period. The set adjustment period is a default written in control program indicating the interval between two consecutive frequency adjustments, such as 2 min. That is to say, as the frequency being adjusted, the increased frequency would be used as the second target frequency, during the next set adjustment period, the second target frequency is being kept unchanged until exiting the fuzzy control process to perform the indoor temperature PID control, or turning off the air conditioner, or the next set adjustment period ends. As the next set adjustment period ends, it should obtain the current running frequency of the compressor again and use the updated current running frequency as the basis to fulfill the process for increasing the frequency.

If it is determined that the difference between the set target coil temperature and the coil temperature is not greater than the overshoot temperature value, it indicates that although the coil temperature has not reached to the set target coil temperature, the difference from the set target coil temperature is comparatively minor and is not greater than the overshoot temperature value. Hence, the frequency is no longer raised subsequently. Thus, the determined second target frequency is maintained unchanged until exiting the fuzzy control process to perform the room temperature PID control or turning off the air conditioner.

Figure 3:
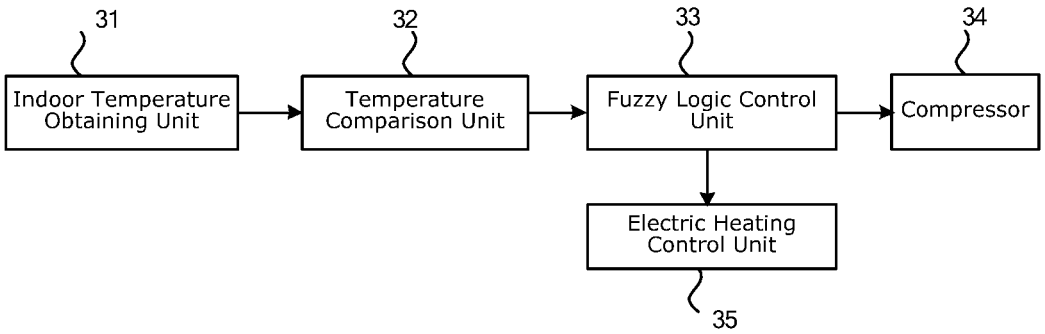
FIG. 3 is a block diagram showing an apparatus for controlling heating operation of air conditioner in accordance with one embodiment of the present invention.

FIG. 3 is a block diagram showing an apparatus for controlling heating operation of air conditioner in accordance with one embodiment of the present invention.

As shown in FIG. 3, the control apparatus includes a plurality of structural units, which will be described in detail as follows.

An indoor temperature obtaining unit 31, which is configured to obtain an indoor temperature;

A temperature comparison unit 32, which is configured to compare the indoor temperature obtained by the indoor temperature obtaining unit 31 with an indoor temperature threshold and output a comparison result;

A fuzzy logic control unit 33, which is configured to calculate a difference between the indoor temperature obtained by the indoor temperature obtaining unit 31 and a set indoor temperature threshold to obtain an indoor temperature difference as the temperature comparison unit 32 outputs a result that the indoor temperature is not greater than the first indoor temperature threshold, and to perform a PID calculation according to the indoor temperature difference to obtain a first target frequency; and to obtain a coil temperature of the heat exchanger within the indoor unit and compare the coil temperature with the set target coil temperature; and to perform a frequency control on the compressor in which the first target frequency is used as the objective frequency point of the compressor if the coil temperature is greater than the set target coil temperature or to increase the current running frequency of the compressor to a second target frequency and perform a frequency control on the compressor in which the greater one between the first target frequency and the second target frequency is used as the objective frequency point of the compressor;

An electric heating control unit 35, which is used to determine whether or not he coil temperature obtained by the fuzzy logic control unit 33 satisfies electric heating device on/off conditions as the fuzzy logic control unit 33 performing the fuzzy control process; to turn on/off the electric heating device as satisfying the electric heating device on/off conditions, wherein the electric heating device on/off conditions are determined according to the coil temperature and the set target coil temperature.

The heating operation control apparatus of the above structure can be applied to an air conditioner by running the corresponding software program shown in the flow chart of FIG. 1. The heating operation control apparatus could solve the problem that the indoor temperature rise slowly and the cold outlet air may make people feel uncomfortable, so as to improve the overall performance of air conditioner in heating operation.

Figure 4:
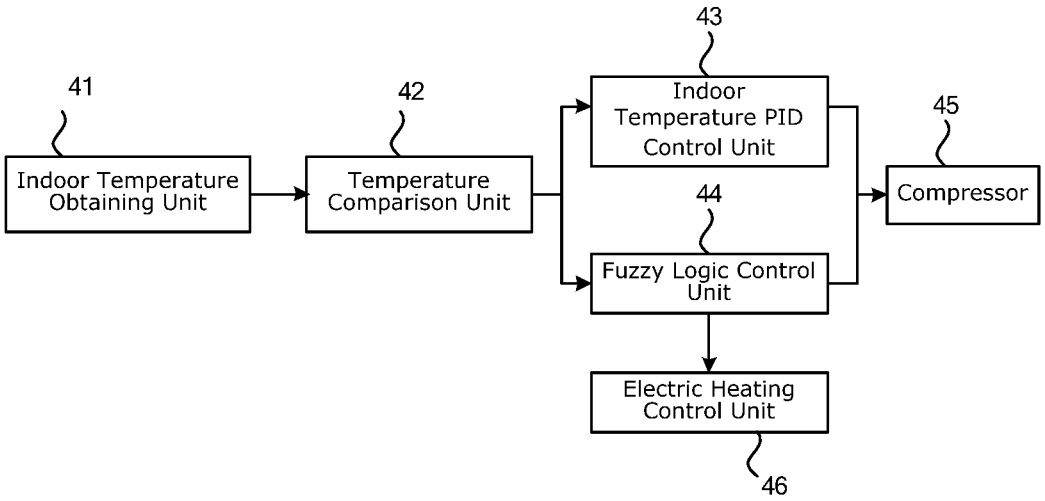
FIG. 4 is a block diagram showing an apparatus for controlling heating operation of air conditioner in accordance with another embodiment of the present invention.

FIG. 4 is a block diagram showing an apparatus for controlling heating operation of air conditioner in accordance with one embodiment of the present invention.

As shown in FIG. 4, the control apparatus includes a plurality of structural units, which will be described in detail as follows.

An indoor temperature obtaining unit 41, which is configured to obtain an indoor temperature;

A temperature comparison unit 42, which is configured to compare the indoor temperature obtained by the indoor temperature obtaining unit 41 with an indoor temperature threshold and output a comparison result;

An indoor temperature PID control unit 43, which is on one aspect before a fuzzy logic control unit 44 performing a fuzzy control process, configured to calculate a difference between the indoor temperature obtained by the indoor temperature obtaining unit 41 and a set indoor temperature threshold to obtain an indoor temperature difference as the temperature comparison unit 42 outputs a result that the indoor temperature is greater than a first indoor temperature threshold, and to perform a PID calculation according to the indoor temperature difference to obtain a first target frequency; and to perform a frequency control on the compressor in which the first target frequency is used as the objective frequency point of the compressor 45; which also on another aspect in the mid of the fuzzy logic control unit 44 performing the fuzzy control process during which the indoor temperature obtaining unit 41 continues to obtain an indoor temperature and outputs it to the temperature comparison unit 42, if the temperature comparison unit 42 outputs a result that the indoor temperature is greater than a second indoor temperature threshold and the fuzzy logic control unit 44 exits, is configured to perform a frequency control on the compressor in which the first target frequency calculated based on the indoor temperature difference is used as the objective frequency point of the compressor 45.

The fuzzy logic control unit 44, which is configured to calculate a difference between the indoor temperature obtained by the indoor temperature obtaining unit 31 and a set indoor temperature threshold to obtain an indoor temperature difference as the temperature comparison unit 42 outputs a result that the indoor temperature is not greater than the first indoor temperature threshold, and to perform a PID calculation according to the indoor temperature difference to obtain a first target frequency; and to obtain a coil temperature of the heat exchanger within the indoor unit and compare the coil temperature with the set target coil temperature; and to perform a frequency control on the compressor in which the first target frequency is used as the objective frequency point of the compressor if the coil temperature is greater than the set target coil temperature, or to raise the current running frequency of the compressor to a second target frequency and to perform a frequency control on the compressor in which the greater one between the first target frequency and the second target frequency is used as the objective frequency point of the compressor 45.

An electric heating control unit 46, which is used to determine whether or not he coil temperature obtained by the fuzzy logic control unit 44 satisfies electric heating device on/off conditions as the fuzzy logic control unit 44 performing the fuzzy control process; to turn on/off the electric heating device as satisfying the electric heating device on/off conditions, wherein the electric heating device on/off conditions are determined according to the coil temperature and the set target coil temperature.

The heating operation control apparatus of the above structure can be applied to an air conditioner by running the corresponding software program shown in the flow chart of FIG. 2. The heating operation control apparatus could solve the problem that the indoor temperature rise slowly and the cold outlet air may make people feel uncomfortable, so as to improve the overall performance of air conditioner in heating operation.

It can therefore be easily understood that the present invention is not limited to the above-described control methods or control apparatus, but may be subject to many modifications, improvements or replacements of equivalent parts and elements without departing from the inventive idea, as clearly specified in the following claims.

The invention claimed is:

1. A method for controlling heating operation of air conditioner comprises:

obtaining an indoor temperature as the air conditioner working in heating mode and comparing the indoor temperature with a first indoor temperature threshold;

performing a fuzzy control process if the indoor temperature is not greater than the first indoor temperature threshold;

calculating a difference between the indoor temperature and a set target indoor temperature to obtain an indoor temperature difference; performing a proportional-integral-derivative (PID) calculation according to the indoor temperature difference to obtain a first target frequency; obtaining a coil temperature of the heat exchanger within an indoor unit and comparing the coil temperature with a set target coil temperature; if the coil temperature is greater than the set target coil temperature, performing a frequency control on the compressor in which the first target frequency is used as an objective frequency point of the compressor; if the coil temperature is not greater than the set coil temperature, then increasing the current running frequency of the compressor to a second target frequency and performing a frequency control on the compressor in which the greater one between the first target frequency and the second target frequency is used as an objective frequency point of the compressor; wherein after obtaining the coil temperature, determining whether or not it is the first time that the coil temperature is not greater than the set target coil temperature since the air conditioner starts working; if it is the first time that the coil temperature is not greater than the set target coil temperature since the air conditioner starts working, choosing a set heating operation maximum frequency of air conditioner as the second target frequency; if it is not the first time that the coil temperature is not greater than the set target coil temperature since the air conditioner starts working, the current running frequency of the compressor is being increased to obtain a second target frequency between the current running frequency and the set heating operation maximum frequency;

as performing the fuzzy control, determining whether or not the coil temperature satisfies electric heating device on/off conditions; if the coil temperature satisfies the electric heating device on condition, turning on the electric heating device of the air conditioner; if the coil temperature satisfies the electric heating device off condition, turning off the electric heating device of the air conditioner; wherein the electric heating device on/off conditions are determined by the coil temperature and the set target coil temperature.

2. The method for controlling heating operation of air conditioner according to claim 1, wherein performing an indoor temperature PID control if the indoor temperature is greater than the first indoor temperature threshold, wherein the indoor temperature PID control comprising performing a frequency control on the compressor in which the first target frequency is used as an objective frequency point of the compressor.

3. The method for controlling heating operation of air conditioner according to claim 1, wherein if it is not the first time that the coil temperature is not greater than the set target coil temperature since the air conditioner starts working, then obtaining the current running frequency of the compressor and adding a set adjustment frequency on the current running frequency every set adjustment period and setting the increased frequency as the second target frequency.

4. The method for controlling heating operation of air conditioner according to claim 3, wherein after each time for adding the set adjustment frequency on the current running frequency, it is firstly to determine whether or not the difference between the set target coil temperature and the coil temperature is not less than a preset overshoot value; if the difference is not less than the preset overshoot value, then as the set adjustment period ends adding the set adjustment frequency on the current running frequency and set the increased frequency as the second target frequency; otherwise the second target frequency is kept unchanged.

5. The method for controlling heating operation of air conditioner according to claim 1, wherein comprises:

as performing the fuzzy control process, obtaining the indoor temperature and comparing the indoor temperature with a second indoor temperature threshold; wherein the second indoor temperature threshold is greater than the first indoor temperature threshold; if the indoor temperature is greater than the second indoor temperature threshold, exiting the fuzzy control process.

6. The method for controlling heating operation of air conditioner according to claim 5, wherein after exiting the fuzzy control process, performing an indoor temperature PID control in which the first target frequency is used as an objective frequency point of the compressor.

7. An apparatus for controlling heating operation of air conditioner comprises:

an indoor temperature obtaining unit configured to obtain an indoor temperature;

a temperature comparison unit configured to compare the indoor temperature obtained by the indoor temperature obtaining unit with an indoor temperature threshold and output a comparison result;

a fuzzy logic control unit configured to calculate a difference between the indoor temperature obtained by the indoor temperature obtaining unit and a set indoor temperature threshold to obtain an indoor temperature difference as the temperature comparison unit outputs a result that the indoor temperature is not greater than the first indoor temperature threshold, and to perform a proportional-integral-derivative (PID) calculation according to the indoor temperature difference to obtain a first target frequency; and to obtain a coil temperature of the heat exchanger within an indoor unit and compare the coil temperature with the set target coil temperature; and to perform a frequency control on the compressor in which the first target frequency is used as the objective frequency point of the compressor if the coil temperature is greater than the set target coil temperature or to increase the current running frequency of the compressor to a second target frequency and perform a frequency control on the compressor in which the greater one between the first target frequency and the second target frequency is used as the objective frequency point of the compressor; wherein the fuzzy logic control unit is configured to, after obtaining the coil temperature, determine whether or not it is the first time that the coil temperature is not greater than the set target coil temperature since the air conditioner starts working; if it is the first time that the coil temperature is not greater than the set target coil temperature since the air conditioner starts working, the fuzzy logic control unit is configured to choose a set heating operation maximum frequency of air conditioner as the second target frequency; if it is not the first time that the coil temperature is not greater than the set target coil temperature since the air conditioner starts working, the current running frequency of the compressor is being increased to obtain a second target frequency between the current running frequency and the set heating operation maximum frequency; and an electric heating control unit configured to determine whether or not he coil temperature obtained by the fuzzy logic control unit satisfies electric heating device on/off conditions as the fuzzy logic control unit performing the fuzzy control process; to turn on/off the electric heating device as satisfying the electric heating device on/off conditions, wherein the electric heating device on/off conditions are determined according to the coil temperature and the set target coil temperature;

wherein the indoor temperature obtaining unit, the temperature comparison unit, the fuzzy logic control unit and the electric heating control unit are each implemented by at least one processor.

8. The apparatus for controlling heating operation of air conditioner according to claim 7, wherein in the mid of the fuzzy logic control unit performing the fuzzy control process during which the indoor temperature obtaining unit continues to obtain an indoor temperature, if the temperature comparison unit outputs a result that the indoor temperature is greater than a second indoor temperature threshold, the fuzzy logic control unit exits, wherein the second indoor temperature threshold is greater than the first indoor temperature threshold.

9. The apparatus for controlling heating operation of air conditioner according to claim 8, includes:

an indoor temperature PID control unit configured to perform a frequency control on the compressor in which the first target frequency is used as the objective frequency point of the compressor under the condition that either the temperature comparison unit outputs a result that the indoor temperature is greater than the first indoor temperature threshold or the indoor temperature is greater than the second temperature threshold and the fuzzy logic control unit exits.

* * * * *